US006012459A

United States Patent [19]

Keefe

[11] Patent Number: 6,012,459

[45] Date of Patent: Jan. 11, 2000

[54] ON-BOARD LIGHTER SYSTEM FOR SMOKER'S ACCESSORY

[75] Inventor: Wayne B. Keefe, Mississauga, Canada

[73] Assignee: 1149235 Ontario Inc., Toronto, Canada

[21] Appl. No.: 09/022,541

[22] Filed: Feb. 12, 1998

[51] Int. Cl.[7] ..... A24F 13/02; A24D 1/04; A24D 3/00; A24B 15/00; A24B 15/10

[52] U.S. Cl. ..... 131/185; 131/187; 131/200; 131/201; 131/202; 131/331

[58] Field of Search ..... 131/175, 185, 131/187, 200, 201, 202, 315.2, 331

[56] References Cited

U.S. PATENT DOCUMENTS

| | | | |
|---|---|---|---|
| 4,790,332 | 12/1988 | Wallace | 131/175 |
| 4,993,435 | 2/1991 | McCann | 131/330 |
| 5,160,518 | 11/1992 | Vega, Jr. | 55/385.8 |
| 5,388,595 | 2/1995 | Shafer | 131/329 |
| 5,396,907 | 3/1995 | Henao et al. | 131/175 |
| 5,497,791 | 3/1996 | Bowen et al. | 131/175 |
| 5,529,078 | 6/1996 | Rehder et al. | 131/175 |
| 5,598,853 | 2/1997 | Hyre | 131/175 |
| 5,752,527 | 5/1998 | Bowen et al. | 131/175 |

FOREIGN PATENT DOCUMENTS

| | | |
|---|---|---|
| WO 95/02970 | 2/1995 | WIPO . |
| WO 97/41744 | 11/1997 | WIPO . |

OTHER PUBLICATIONS

PCT/CA 99/00111 International Search Report May 1999.

*Primary Examiner*—Stanley S. Silverman
*Assistant Examiner*—Jacqueline A. Ruller
*Attorney, Agent, or Firm*—Banner & Witcoff, Ltd.

[57] ABSTRACT

A hand-held cigarette smoking device for capturing sidestream smoke with an on-board cigarette lighter. The device has a cigarette combustion chamber, a sidestream smoke filtration chamber, a plenum for conducting sidestream smoke from a lit cigarette in the combustion chamber into the sidestream smoke filtration chamber, an electric fan for drawing sidestream smoke from the combustion chamber through the plenum and into the sidestream smoke filtration chamber and a controller for the fan. The on-board cigarette lighter comprises a lighter filament, flexible wire for supplying electric current to the filament, a reciprocal mounting device for the lighter filament positioned in the combustion chamber, a detent for locating the lighter filament at predetermined cigarette positions to locate the filament at a respective cigarette tip end when inserted in the combustion chamber for smoking, the flexible wire being of a length to accommodate such position of the filament. A finger grip is provided external of the device and is connected to the detent for manually moving and locating the detent in a desired cigarette position. The on-board cigarette lighter enhances the overall efficiency of the hand-held cigarette smoking device due to lighting of the cigarette within the cigarette combustion chamber.

12 Claims, 3 Drawing Sheets

ON-BOARD LIGHTER SYSTEM FOR SMOKER'S ACCESSORY

FIELD OF THE INVENTION

This invention relates to lighter units for use in hand-held cigarette smoking devices, particularly those adapted for capturing sidestream smoke.

BACKGROUND OF THE INVENTION

Various hand-held devices for capturing sidestream smoke and/or exhaled cigarette smoke are available, for example, U.S. Pat. Nos. 4,790,332 and 4,993,435 describe hand-held cigarette smoking devices and smoker's accessories which provide for positioning of a lit cigarette in the unit where sidestream smoke emanating from the lit cigarette is captured within the unit. These devices require that the cigarette be lit externally of the unit then positioned within it to continue smoking. Usually the process of lighting the cigarette releases very little sidestream smoke before it is inserted in the unit, however, there may be situations where even lighting a cigarette in the open may not be appropriate.

Various designs have been contemplated to light the cigarette within the unit, such as described in U.S. Pat. No. 5,160,518. The cigarette combustion chamber is provided with an access port to permit insertion of a match or lighter flame to light the cigarette within the device. U.S. Pat. No. 5,497,791 contemplates the use of a flameless lighter which can be located in the device to direct a hot stream of gases at the end of a cigarette within the unit to ignite the cigarette. Such device generally requires a source of fuel and an ignition catalyst with some means for bringing the fuel and catalyst into contact when it is desired to light the cigarette. The fuel cell may have a pump with an ignition module where the fuel cell is activated by depressing a switch and then releasing it after the cigarette is lit. Normally the fuel cell would be positioned in a manner to direct the hot stream of gases to within the cigarette tube which houses the cigarette to be lit. It is generally understood that such devices are comparatively large and usually require refueling.

In applicant's published international application WO 97/41744 published Nov. 13, 1997, an improved system for a hand-held smoker's device for sidestream smoke control is described. The device provides for a cigarette combustion chamber, a sidestream smoke filter chamber, a plenum for conducting sidestream smoke from a lit cigarette in the combustion chamber into the sidestream smoke filtration chamber, an electric fan for drawing sidestream smoke from the combustion chamber through the plenum and into the sidestream smoke filtration chamber and as well a controller for the fan operation. It is contemplated in the published application that a cigarette lighter to light a cigarette in the combustion chamber may be incorporated into the unit without increasing the overall size of the unit. A "press and hold" button may be used to cause an element to glow and thereby light the cigarette where the internal lighter may be mounted on adjustable brackets to allow the use of different cigarette lengths. Applicant has now developed an on-board cigarette lighter which functions in a surprisingly superior manner compared to the prior art devices as well as that contemplated in the above PCT application.

Accordingly, it is an object of an aspect of the invention to provide an on-board cigarette lighter which provides for "foolproof" operation, ensures lighting of the cigarette and provides for manual position adjustment of the filament within the combustion tube by way of the use of a detent.

SUMMARY OF THE INVENTION

In accordance with an aspect of the invention, a hand-held cigarette smoking device for capturing sidestream smoke has an on-board cigarette lighter. The device includes:

i) a cigarette combustion chamber;

ii) a cigarette holder at an end of said cigarette combustion chamber;

iii) a sidestream smoke filtration chamber;

iv) means for conducting sidestream smoke from a lit cigarette in said combustion chamber into said sidestream smoke filtration chamber;

v) an electric fan for drawing sidestream smoke from said combustion chamber, through said conducting means and into said sidestream smoke filtration chamber;

vi) means for controlling fan operation;

vii) said on-board cigarette lighter positioned in an end of said cigarette combustion chamber opposite said cigarette holder; and comprising:

a) a lighter filament;

b) flexible wire for supplying electrical current to said filament;

c) a guide extending along said cigarette combustion chamber and means for mounting said lighter filament on said guide for reciprocal movement of said filament toward and away from said cigarette holder;

d) a detent connected to said mounting means for locating said lighter filament at predetermined cigarette positions to locate said filament at a cigarette tip end for a predetermined cigarette length when such cigarette is inserted in said combustion chamber for smoking, said flexible wire being of a length to accommodate such reciprocal movement of said filament;

e) finger grip means connected to said detent for manually moving and locating said detent means at a desired cigarette length position.

The reciprocal mount for the lighter filament preferably comprises a guide rail protruding from a block position in the combustion chamber and a follower mounted on the rail. The filament is connected to the follower where the detent is mounted on the follower and extends through a longitudinal slot in the combustion chamber. The detent includes a finger grip to facilitate positioning of the detent at the desired size.

BRIEF DESCRIPTION OF THE DRAWINGS

Various embodiments of the invention are described with respect to the drawings wherein.

DETAILED DESCRIPTION OF THE PREFERRED EMBODIMENTS

Figure 1:
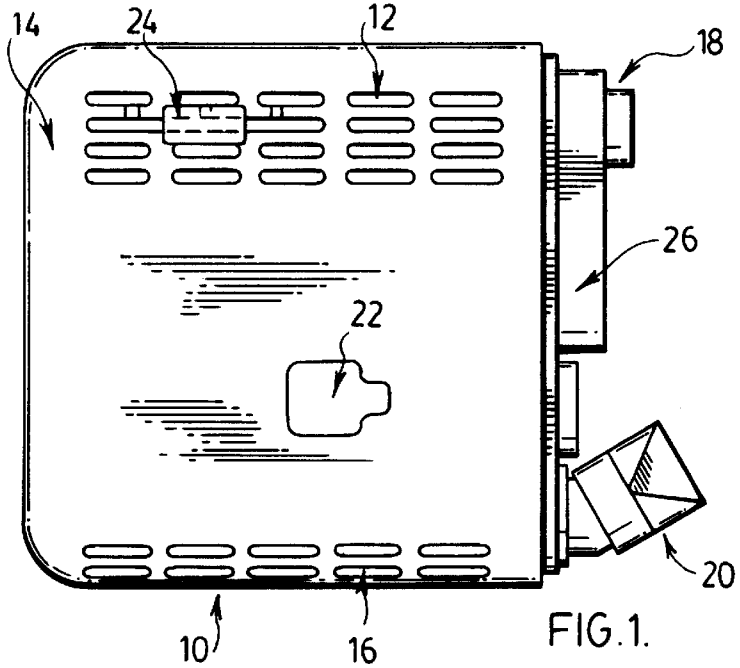
FIG. 1 is a bottom plan view of the hand-held cigarette smoking device.

In accordance with a preferred embodiment of the invention, a hand-held cigarette smoking device for capturing sidestream smoke is generally designated 10 in FIG. 1. The bottom view of the device shows ventilation slots 12 through which ambient air flows in supplying air to a combustion chamber housed within the body portion 14. On the opposite side of the device 10 are ventilation slots 16 which, in accordance with this particular embodiment, provide for egress of filtered smoker exhaled air. The smoker using the device 10 smokes a cigarette which is held in holder 18. When it is desired to exhale into the device, in accordance with this particular embodiment the device is equipped with a mouthpiece 20 into which the smoker exhales. The exhaled smoke passes into an exhale filter housed in the body portion 14. On the underside of the device, is a manually actuated switch 22 which controls the operation of the fan and as well, the operation of a cigarette lighter provided within the combustion chamber. In addition, on the underside of the body portion 14 is a finger grip 24 which is connected to a detent which adjusts position of the lighter within the combustion chamber for lighting in the respective position the usual regular size, king size and 100 mm size cigarettes. It is also appreciated that there are other standard sizes of cigarettes, such as, 80 mm and 90 mm.

Also housed within the body portion 14 is a sidestream smoke filter. A plenum generally designated 26 transfers or conducts sidestream smoke extracted from the combustion chamber 12 and passes it through to the sidestream smoke filter. This construction may be of the type described in the aforementioned applicant's published PCT application WO 97/41744, the subject matter of which if hereby incorporated by reference.

Figure 2:
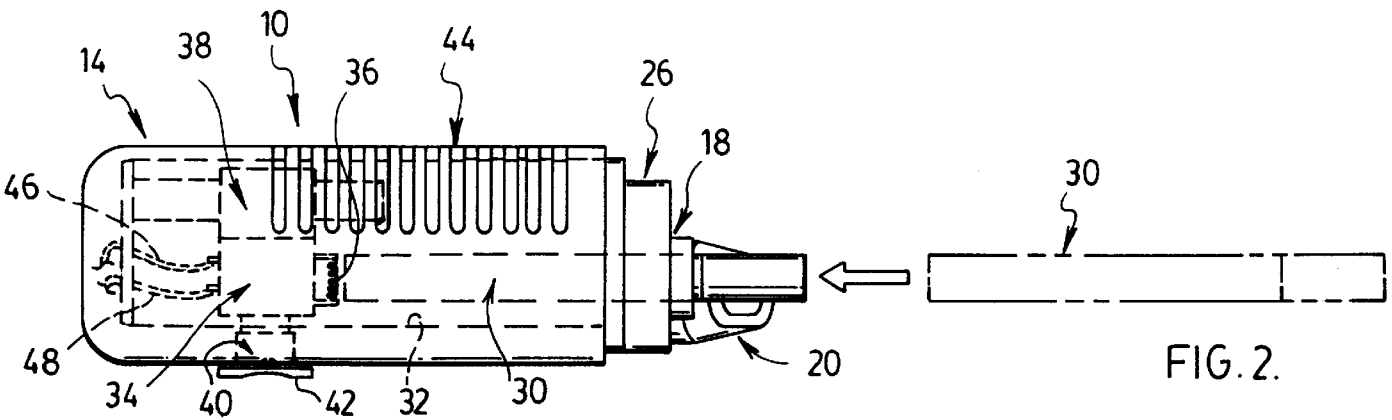
FIG. 2 is a side elevation showing the insertion of a cigarette within the combustion chamber which is subsequently to be lit within the combustion chamber.

As shown in FIG. 2, the device 10 has a cigarette 30 inserted through cigarette holder 18. The position of the cigarette 30 within the combustion chamber 32 is shown in dot. In addition, the positioning of the cigarette lighter generally designated 34 is also shown in dot within the combustion chamber. The lighter filament 36 is mounted on a reciprocal device 38, the position of which is controlled by a detent 40 which is moved by finger grip 42. The operation of the detent will be described in more detail with respect to FIGS. 5 and 6. On the upper part of the body portion 14 is located additional ventilation slots 44 which allow escape of heat from above the combustion chamber during the process of smoking a cigarette within the combustion chamber 32. Flexible wires 46 and 48 are connected through the filament carrier 34 and are of sufficient length to allow positioning of the filament 36 in the desired positions depending upon the length of the cigarette 30 inserted within the combustion chamber 32.

Figure 3:
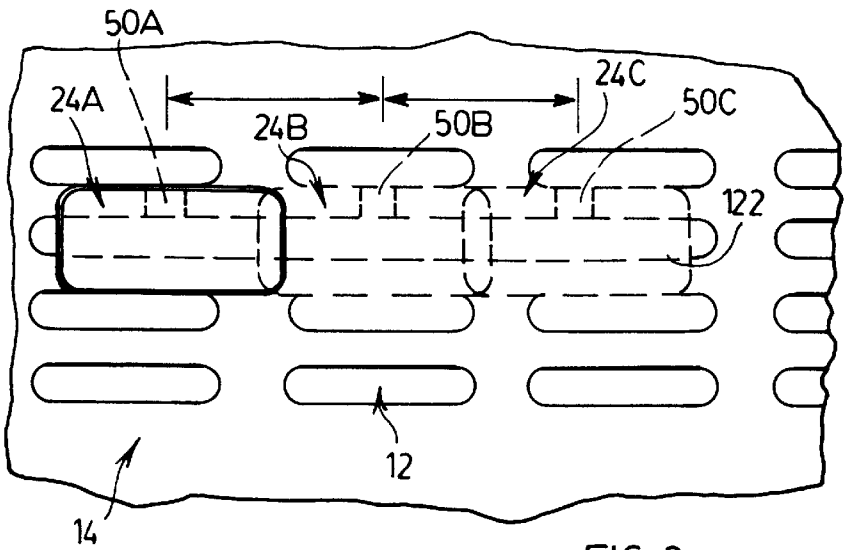
FIG. 3 is an enlarged view of the markings on the exterior of the device to indicate cigarette size.

As shown in FIG. 3, the underside of the body portion 14 which has the ventilation slots 12 formed therein demonstrates in dotted line three positions 24A, 24B and 24C for the respective cigarette positions corresponding to the selected 100 mm size, king size and regular size. As will be described with respect to FIGS. 5 and 6, the finger grip 24 includes a detent which in accordance with this particular embodiment registers with notches 50A, 50B and 50C to precisely locate the filament 36 for lighting the cigarette, depending upon its length. Normally a smoker only smokes the same size cigarette, so positioning of the filament to various positions may not be required that often, however, when that flexibility is desired, one can readily move the filament by use of the finger grip 24 to the respective A, B and C positions.

Figure 4:
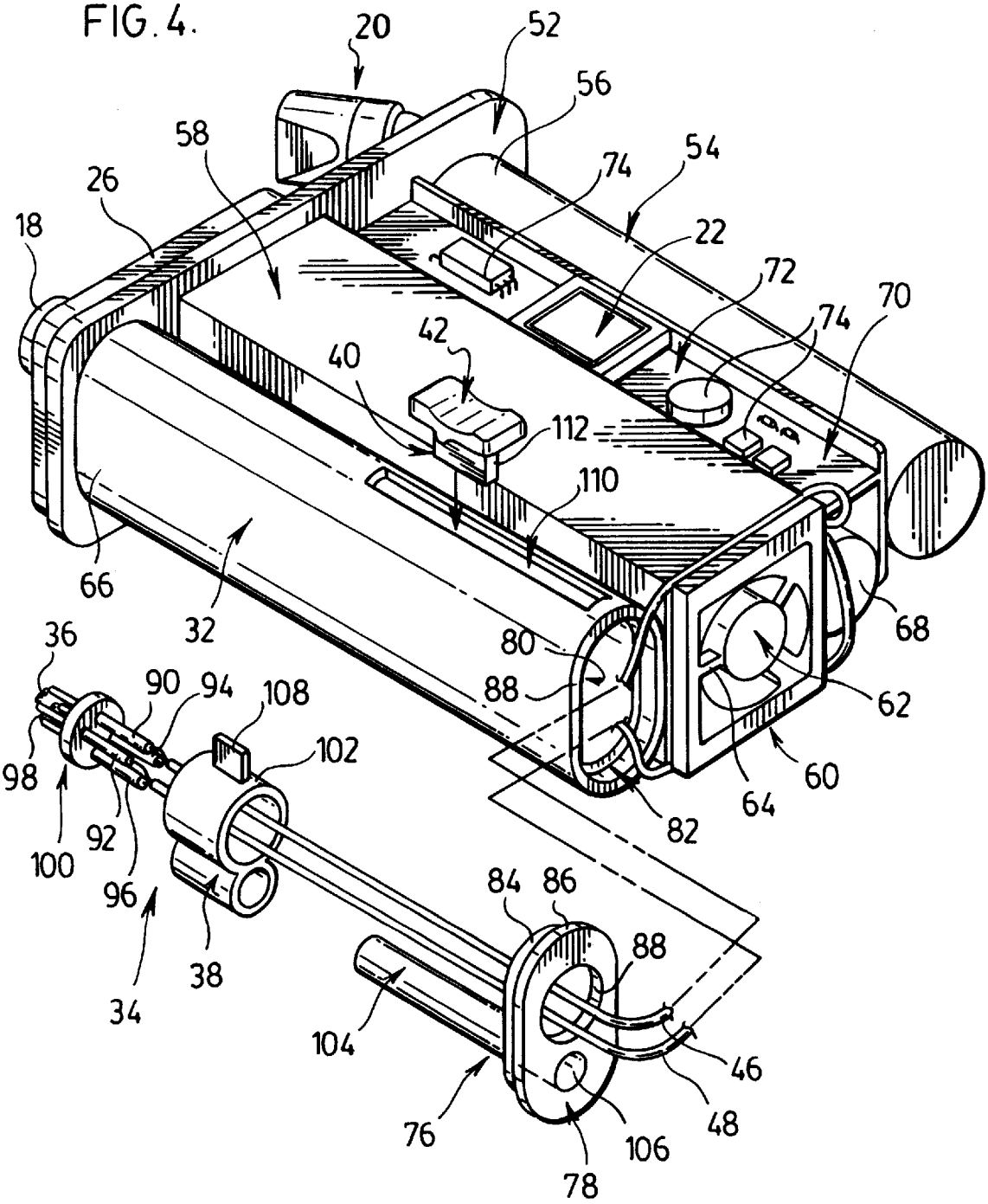
FIG. 4 is a perspective view of the interior of the hand-held cigarette smoking device showing an exploded view of the cigarette lighter.

With reference to FIG. 4, the cover of the body portion 14 is removed. The end of the device includes a base plate 52 which supports several components of the smoker's device. The exhale filter 54 is secured to the base plate 52 and is in communication with the mouthpiece 20. Preferably, the end 56 is releasably secured to the base plate 52 to allow ready replacement thereof. Also secured to the base plate 52 is the housing 58 for the sidestream smoke filter. Although not shown, the sidestream smoke filter is positioned within the housing 58. At the other end 60 of the housing is positioned the fan motor 62 supported by standards 64 in which a fan unit is located within the housing 58. The fan exhausts filtered air over the standards 64. The body portion 14 includes a vent aligned with the fan to allow the escape of the filtered gases.

The combustion chamber 32 is also secured to the base plate 52 at its end 66. The cigarette holder 18 is supported either directly on the base plate 52 or on the plenum shell 26. The holder 18 is in communication with the combustion chamber 66 to permit positioning of a cigarette within the combustion chamber and which is to be lit by the cigarette lighter 34. In accordance with this particular embodiment, a rechargeable battery 68 is secured within the electronic controller casing 70 and is preferably hard wired to the controller. The casing 70 includes circuit board 72 with electronic componentry 74 in the form of a process controller. The on/off switch 22 is positioned on the circuit board 72 for purposes of at least controlling operation of the fan motor 62 as well as the cigarette lighter 34. In view of the compact nature of the hand-held device, the electronic controller is made of componentry 74 which is programmable in order to optimize the coordination of various sensors and operation of the fan and cigarette lighter. Many of the additional control features of the electronic controller are described in the aforementioned published PCT application WO 97/41744. Additional control features may include, fast charging of battery, limiting the activation time of the filament 36 should the switch be accidentally held in the "on" position and instituting a clean cycle of the filament after the unit is connected to a terminal for charging, but before recharging of the battery takes place.

The combustion chamber 32, in accordance with this preferred embodiment is somewhat oval or elongated in the vertical axis. It is appreciated that the lighter may be mounted within the combustion chamber 32 in a variety of ways. In accordance with this preferred embodiment, the cigarette lighter 34 is carried on a mount 76 which includes a block 78 adapted for fitment in the open end 80 of the cigarette combustion chamber 32. In accordance with this particular embodiment, the opening 80 includes a recessed portion 82. The block 78 includes an insert 84 which fits within the recess 82. The outer flange 86 abuts the outer edge 88 of the open end 80 of the combustion chamber 32. The block 78 includes an aperture 88 through which the flexible wires 46 and 48 extend to supply electrical current to the terminals 90 and 92 which in turn cause the filament 36 to glow. In accordance with this preferred embodiment, the wires 46 and 48 are connected to two sets of terminals 90 and 92; and 94 and 96 to supply respectively, filaments 36 and 98. The duplication of the filaments ensures that if one should breakdown a second one is available for lighting cigarettes. Alternatively, with two filaments, greater heat is generated to ensure lighting of the cigarette end. The filaments 36 and 98 are carried in a disc 100 which in accordance, with this particular embodiment is fitted within the hollow cylindrical filament carrier 102. The disc is preferably of ceramic material to protect the solder connections of wires 46 and 48 to the electrodes 90, 92, 94 and 96 from the heat of the filament and isolate the electrodes from the mainstream smoke. The filament carrier 102 is secured to or integrally formed with a hollow cylindrical follower 38 which is adapted for slidable engagement with a guide rail 104 protruding from the block 78.

As shown in FIG. 4, the guide rail 104 may be friction fitted or in some other manner secured at 106 within the block 78. The hollow cylindrical follower 38, in sliding along the rail 104, guides the movement of the filament carrier 102 to ensure it is at the proper height within the combustion chamber 32 and is thereby aligned with the cigarette holder 18. To also ensure that the filament carrier 102 is laterally aligned with the cigarette holder 18, the carrier 102 includes an upwardly extending arm 108. The arm 108 extends upwardly through a slot 110 formed in the upper portion of the combustion chamber 32. The finger grip 42 which includes part of the detent 40, engages the arm 108 while permitting relative movement of the detent 40 when engaging the notches 50 in a manner to be discussed with respect to FIGS. 5 and 6. In accordance with this particular embodiment, the finger grip 42 includes a hollow rectangular shaped depending post 112 which engages the arm 108.

Figure 5:
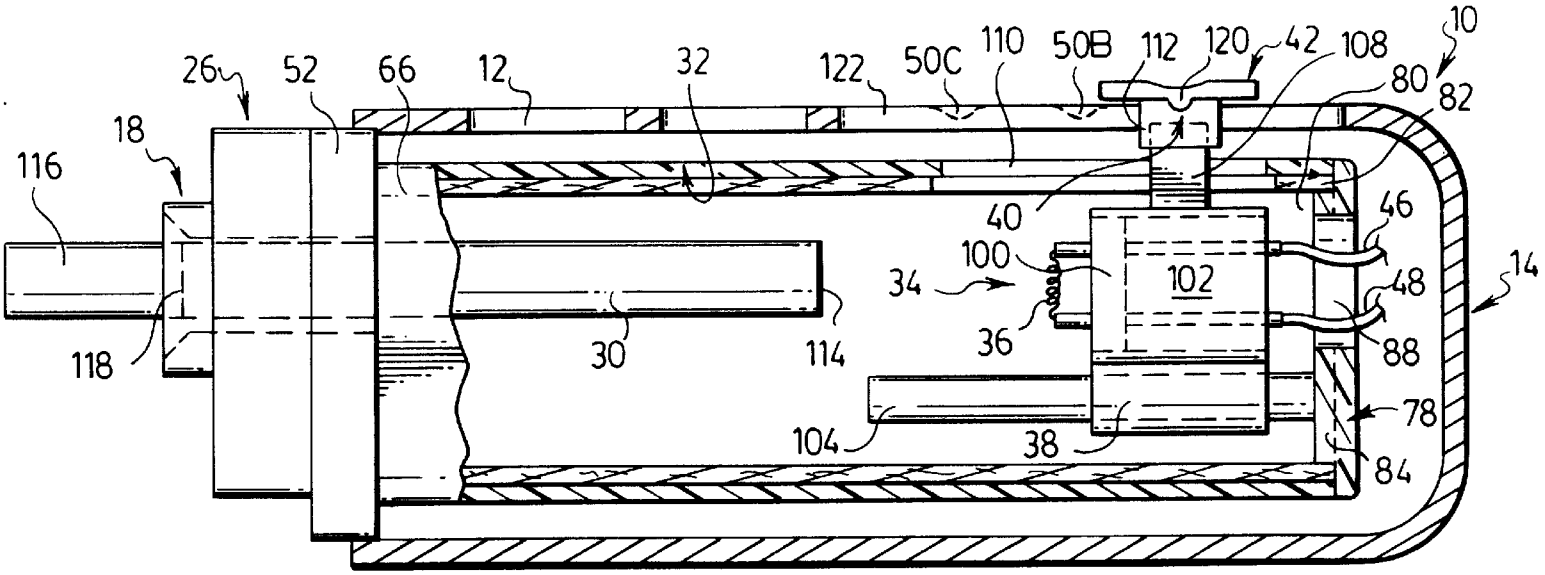
FIG. 5 is a section through the combustion chamber showing the lighter in a first position.
Figure 6:
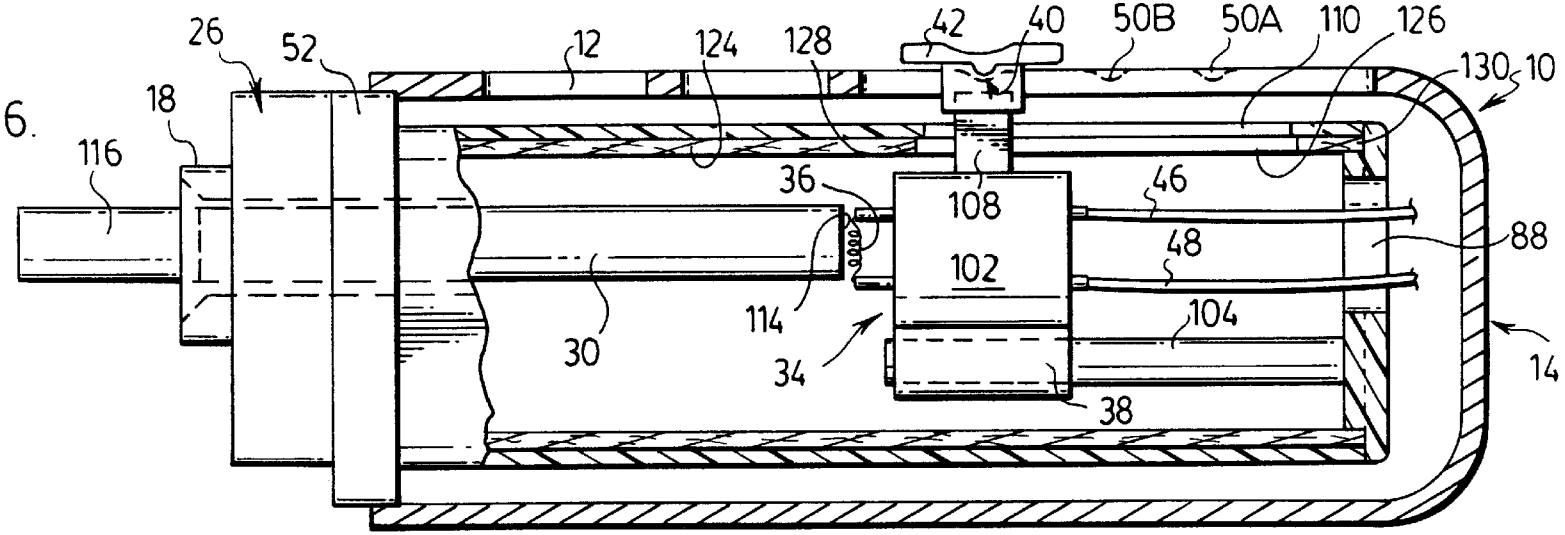
FIG. 6 is a section through the combustion chamber showing the lighter moved to a selected position ready to light a cigarette of corresponding predetermined length as inserted in the combustion chamber.

The section of FIG. 5 shows the relative positioning of the cigarette lighter 34 within the combustion chamber 32. In addition, the relative positioning of the cigarette 30 in the holder 18 locates its end portion 114 and as well preferably locates the filter tip portion 116 outwardly of the holder 18. The preferred manner in which the cigarette is inserted into the device, is for the smoker to select with the detent finger grip, the desired cigarette length. The smoker then inserts the cigarette through the holder 18 until the cigarette end 114 abuts the filament 36. This procedure automatically locates the filter tip 116 outside the holder. Hence, the sequence as shown in FIGS. 5 and 6, is modified to the extent that the cigarette is inserted after the filament is located at the predetermined cigarette length. Another technique which may be employed by the smoker includes locating the tipping line 118 just within the holder 18 to thereby position the tobacco end 114 in the correct position, hence, when the lighter is moved to the corresponding cigarette length, the filament 36 is adjacent the end 114, as will be discussed with respect to FIG. 6. It is appreciated that the holder 18 may include a mouthpiece. The filter tip 116 could be inserted in the mouthpiece and the mouthpiece in turn assembled on the holder 18. This may be preferable to certain applications of the invention, particularly depending upon certain customs.

The block 78 is mounted in the end 80 of the combustion chamber. By positioning the portion 84 in the recess 82. The flexible wires 46 and 48 extend through the opening 88 of the block 78. The rail 104 protrudes from the block 78 on which the follower 38 is mounted. The filament 36 is positioned within the filament holder 102 by friction fitting of the disc 100 within the holder 102. The arm 108 extends upwardly through slot 110 and is engaged by the hollow post portion 112 of the finger grip. The finger grip 42 includes the detent 40 which is made up of a depending nib or tit 120 and respective notches 50A, 50B and 50C. The hollow post 112 moves in a reciprocal manner within a slot 122 which is also shown in dot in FIG. 3. Friction fitting of the disc 100 in the holder 102 provides a blind hole in the holder behind the disc. Air which is brought into the combustion chamber by the fan does not draw any volatiles from the solder connections because air can not flow through the holder 102.

As shown in FIG. 6, the cigarette lighter 34 has been moved from the 100 mm position, as determined by notch 50A to the regular size position, as determined by notch 50C. The cigarette 30 as inserted in the device 10 is a regular size cigarette. By moving the detent 40 by engaging the finger grip 42 to the notch 50C the filament 36 is located at the end 114 of the cigarette. The positioning of the filament is determined by the follower 38 riding on the rail 104 and as well, the arm 108 riding within the slot 110. With the filament in the respective cigarette length position, the smoker may depress the button 22 which if held at the "in" position, performs two functions. Through the electronic circuitry 74 the fan motor 62 is turned on to ensure an air flow through the wall of the combustion chamber 32 and into the sidestream smoke filter. Secondly, electrical current from the battery 68 is supplied via wires 46 and 48 to the filament 36. This causes the filament to glow. Puffing on the cigarette 30 thereby lights the end 114 of the cigarette. The filament is made of materials which preferably do not effect the taste and flavour of the lit cigarette. Once the cigarette is lit the smoker releases the switch 22 to allow it to move to its normal position.

The electronic circuitry of the device removes current in lines 46 and 48 but continues to operate the fan 62. As is appreciated by those skilled in the art, the electronic circuitry, which includes a controller, may be programmed to sense if the fan is not operating, to start the fan in the event the button is depressed and secondly, if the button is held in the "in" position, to then supply current to the filament 36. It is appreciated if the button is depressed to its "in" position for only a moment and allowed to then move to its out position, the filament 36 will not be activated but the fan 62 will be turned on. This may occur when for whatever reason the smoker decides to insert a lit cigarette within the device and does not require ignition by way of the lighter 34. The controller is also programmed to turn the fan "off" if the fan is "on" and the switch is depressed to the "in" position regardless of whether or not it is held. Holding of the button in the "in" position will only turn the filament 36 on if the fan is "off" before the button is depressed.

Depending upon the capacity of the fan motor 62, it may be desirable to fill the opening 88 with a suitable material to reduce the amount of air which flows through the opening. As is described in applicant's published PCT application WO 97/41744, the fan is controlled to operate in a manner which always ensures that sidestream smoke emanating from the cigarette flows through the plenum into the sidestream smoke filter while at the same time achieving normal burn rates of the cigarette and normal smoking temperatures for the cigarette to ensure consistent flavour and taste. It is appreciated that the cigarette combustion chamber 32 may include a liner 124 which is readily replaceable. The plenum 26 may be removed from the rear wall 52 and the liner 124 slid out of the chamber. The liner may include a slot 126 which extends from region 128 to its end portion 130 so as to permit sliding over the arm 108. The liner may be replaced from time to time, usually after one or two packages of cigarettes have been smoked in the device. At the same time ashes and like may be removed from the combustion chamber when the plenum 26 is pulled off of the support 52. The sidestream smoke filter may also require replacement. Various types of filtering devices are not only described in applicant's published PCT application WO 97/41744 but as well are described in applicant's published PCT application WO 94/23599, the subject matter of which is hereby incorporated by reference.

Alternatively, by virtue of the finger grip post 112 being friction fitted on the arm 108, the finger grip 112 may be pulled off the arm 108 to permit removal of the shell body portion 14 and replacement of combustion chamber liner, sidestream smoke filter and exhale filter.

The cigarette lighter of this invention readily incorporates the various lengths of cigarettes to facilitate the smoker's desire to smoke their own brand. The lighter is readily located by virtue of the detent system where the flexible wires 46 and 48 move inwardly and outwardly of the opening to the extent shown in FIGS. 5 and 6 to accommodate ready movement of the cigarette lighter holder 102. The lighter is mounted within the combustion chamber on a guide rail system which is secured to the chamber to ensure consistent location of the lighter relative to the cigarette end. The electronic control for the lighter is such to avoid accidental use of the lighter, particularly leaving it in the "on" position, which could cause overheating of the device. The lighter will only work when the fan is on to ensure that sidestream smoke does not build up in the combustion chamber and hence, escape outwardly therefrom. The finger grip 42 is located on the same side as the switch for the device. Normally when the unit is in the smoker's hands the underside of the device is looked at so that the finger grip can be readily moved to the desired detent position and the switch conveniently located for activation by the smoker's thumb.

Although preferred embodiments of the invention have been described herein in detail, it will be understood by those skilled in the art that variations may be made thereto without departing from the spirit of the invention or the scope of the appended claims.

I claim:

1. In a hand-held cigarette smoking device for capturing sidestream smoke having an on-board cigarette lighter, said device having:

i) a cigarette combustion chamber;

ii) a cigarette holder at an end of said cigarette combustion chamber;

iii) a sidestream smoke filtration chamber;

iv) means for conducting sidestream smoke from a lit cigarette in said combustion chamber into said sidestream smoke filtration chamber;

v) an electric fan for drawing sidestream smoke from said combustion chamber, through said conducting means and into said sidestream smoke filtration chamber;

vi) means for controlling fan operation;

vii) said on-board cigarette lighter positioned in an end of said cigarette combustion chamber opposite said cigarette holder end; and comprising:

a) a lighter filament;

b) flexible wire for supplying electrical current to said filament;

c) a guide extending along said cigarette combustion chamber and mean for mounting said lighter filament on said for reciprocal movement of said filament toward and away from said cigarette holder;

d) a detent connected to said mounting means for locating said lighter filament at predetermined cigarette positions to locate said filament at a cigarette tip end for a predetermined cigarette length when such cigarette is inserted in said combustion chamber for smoking, said flexible wire being of a length to accommodate such reciprocal movement of said filament; and e) finger grip means connected to said detent for manually moving and locating said detent means at a desired cigarette length position.

2. In a cigarette smoking device of claim 1, further comprising a block mounted in said combustion chamber, said guide protruding from said block.

3. In a cigarette smoking device of claim 2, said guide comprising a guide rail protruding from said block and a follower mounted on said rail, said mounting means being connected to said follower, said detent means being connected to said follower and extending through a longitudinal slot in said combustion chamber.

4. In a cigarette smoking device of claim 3, said block being an end cap mounted in one of the ends of said combustion chamber, said flexible wires extending through an opening in said end cap.

5. In a cigarette smoking device of claim 4, having an external shell, said shell having locator marks for visually indicating detent positions for predetermined cigarette lengths.

6. In a cigarette smoking device of claim 1, said fan operation control means comprising means for controlling supply of electric current to said filament, said fan operation control means blocking supply of electric current to said filament if said fan is "off".

7. In a cigarette smoking device of claim 6, said fan operation control means comprising a manually actuated switch having "on" and "off" positions, said switch in said "on" position turning "on" said fan.

8. In a cigarette smoking device of claim 7, said switch being a depressible button switch, said fan operation control means supplying electrical current to said filament when said button is manually held in the depressed position and stop supplying electrical current when said button is released, said fan operation control means turning said fan "off" when said button is depressed a second time.

9. In a cigarette smoking device of claim 1, said lighter having a second filament.

10. In a cigarette smoking device of claim 4, means for filling in said opening in said end cap through which said wires pass.

11. In a cigarette smoking device of claim 5, said predetermined cigarette lengths being regular size, king size and 100 mm size.

12. In a cigarette smoking device of claim 5, said predetermined cigarette lengths being 80 mm and 90 mm size.

* * * * *

UNITED STATES PATENT AND TRADEMARK OFFICE

CERTIFICATE OF CORRECTION

PATENT NO. : 6,012,459
DATED : January 11, 2000
INVENTOR(S) : Wayne B. Keefe

It is certified that error appears in the above-identified patent and that said Letters Patent is hereby corrected as shown below:

Claim 1, column 7,
Line 52, delete "mean" and insert -- means --;
Line 53, immediately after "said" (first occurrence), insert -- guide --.

Signed and Sealed this

Ninth Day of October, 2001

*Attest:*

Nicholas P. Godici

*Attesting Officer*

NICHOLAS P. GODICI
*Acting Director of the United States Patent and Trademark Office*